US006684932B2

(12) United States Patent
Olofsson

(10) Patent No.: US 6,684,932 B2
(45) Date of Patent: Feb. 3, 2004

(54) ARRANGEMENT FOR SLIDING DOORS ON MOBILE UNITS

(75) Inventor: Mats Olof Olofsson, Skellefteå (SE)

(73) Assignee: Alimak AB, Skellefteå (SE)

( * ) Notice: Subject to any disclaimer, the term of this patent is extended or adjusted under 35 U.S.C. 154(b) by 0 days.

(21) Appl. No.: 10/032,821

(22) Filed: Oct. 22, 2001

(65) Prior Publication Data

US 2003/0024657 A2 Feb. 6, 2003

(30) Foreign Application Priority Data

Oct. 23, 2000 (SE) ..... 0003829

(51) Int. Cl.[7] ..... E05D 15/00

(52) U.S. Cl. ..... 160/214; 160/196.1; 160/231.2; 187/328; 187/334; 16/225

(58) Field of Search ..... 160/196.1, 231.1, 160/231.2, 214, 229.1; 187/333, 334, 328; 16/225

(56) References Cited

U.S. PATENT DOCUMENTS 1,556,281 A * 10/1925 Bohnet
2,689,003 A * 9/1954 Helbert et al.
3,003,551 A * 10/1961 Ferris
3,053,318 A * 9/1962 Artman
3,361,189 A * 1/1968 Dixon et al.
3,908,731 A * 9/1975 Runka
4,131,971 A * 1/1979 Saarloos
5,165,142 A * 11/1992 Pilsbury
5,450,694 A * 9/1995 Goranson et al.
5,871,312 A * 2/1999 Haninger et al.
6,082,499 A * 7/2000 O'Donnell
6,209,171 B1 * 4/2001 Pelletier et al.

* cited by examiner

*Primary Examiner*—Blair M. Johnson
(74) *Attorney, Agent, or Firm*—Ware, Fressola, Van der Sluys & Adolphson LLP

(57) ABSTRACT

In an arrangement for sliding doors, a door leaf comprises a number (n) of interlinked and jointed sections (4:1–4:n) in which adjoining sections are able to rotate around a joint axis (A) from a position in which the sections are in alignment with each other to a relative angled position. The door leaf can slide in the door opening (6) in guides (8, 9), each of which comprising a first and a second interacting guide element (8', 8"; 9', 9") arranged on two opposing end edges (22, 23) of the door leaf and the corresponding sides of the door opening. To obtain a sound insulating door, there is an elastically deformable material between the adjoining and relatively flexible sections (4:1–4:n) to separate the sections from each other.

20 Claims, 5 Drawing Sheets

ARRANGEMENT FOR SLIDING DOORS ON MOBILE UNITS

BACKGROUND OF THE INVENTION

1. Technical Field

The present invention concerns an arrangement for sliding doors on mobile units such as lift cages and where a door leaf comprises a plurality of interlinked and jointed sections in which adjoining sections are able to rotate around a joint axis from a position in which the sections are in alignment with each other to a relative angled position, whereby the door leaf can slide in the door opening in guides, each of which comprising a first and second interacting guide elements, the first interacting guide elements arranged on two opposing end edges of the door leaf and the second interacting guide elements arranged on corresponding sides of the door opening.

2. Description of the Background Art

Sliding doors of this type are used in a number of different applications in which the doors are usually arranged to move in the vertical or horizontal plane relative to the door opening. With regard to sliding doors on mobile units such as lift cages and similar devices, there is a particular necessity for them to exhibit sound-insulating qualities, as problems with noise, resonation vibration and structure-borne sound together with other problems are generated while the mobile unit is in motion. On lift cages with sliding doors of the type referred to, i.e. in which the door leaf principally comprises a number of interlinked and jointed sections, a large proportion of the noise is generated in the joints between the sections. This has been a problem especially on rack and pinion lifts due to the many moving mechanical parts that are used to move the lift cage along the mast. It has also become evident that the noise and vibration generated during the motion of the lift cage increases proportionally to the speed, which, as should be understood, limits the speed at which the lift can move without noise being perceived as trying by the occupants.

SUMMARY OF THE INVENTION

One object of the present invention is therefore to achieve an arrangement on a sliding door of the aforesaid type, whereby the noise issue of such a door is essentially eliminated. In particular, the intention is to achieve sound-insulating properties of sliding doors that are arranged in mobile units such as lift cages.

This is achieved by the arrangement in accordance with the present invention exhibiting the distinctive features and characteristics specified in the following claims.

BRIEF DESCRIPTION OF THE DRAWINGS

The following is a description of this invention with references to attached drawings, where.

DETAILED DESCRIPTION OF THE INVENTION

Figure 1:
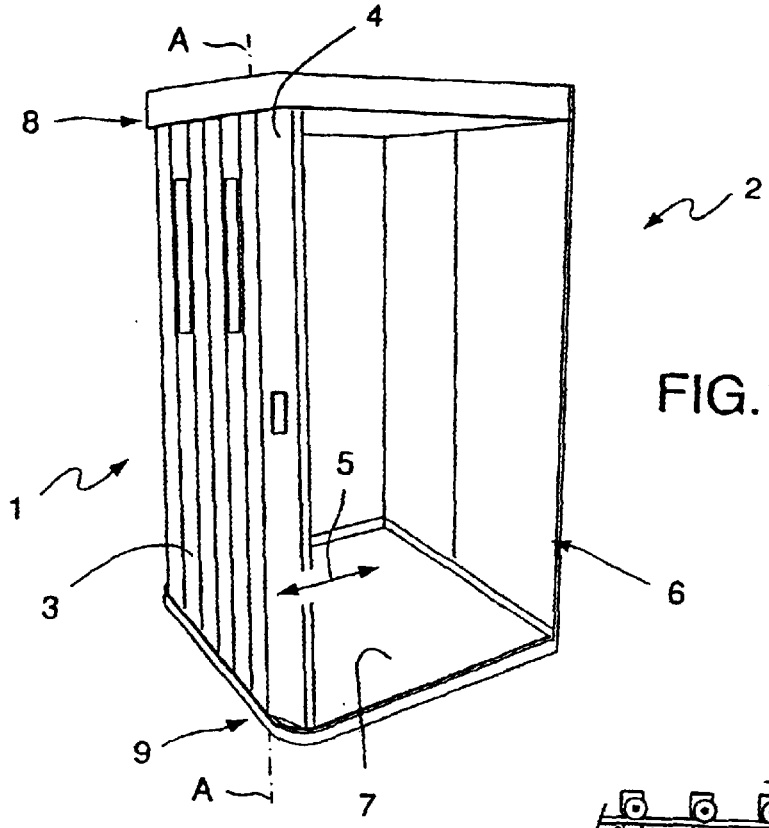
FIG. 1 is a perspective view of a lift cage with sliding door.
Figure 2:
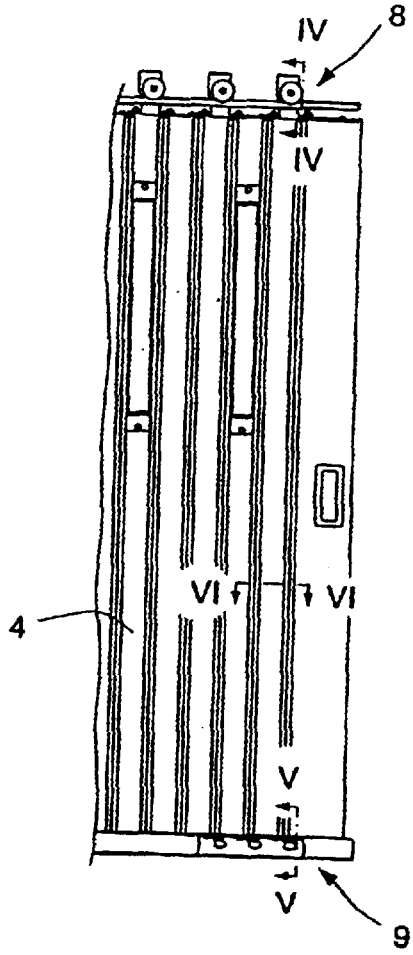
FIG. 2 is a front view of the sliding door shown in FIG. 1.
Figure 3:
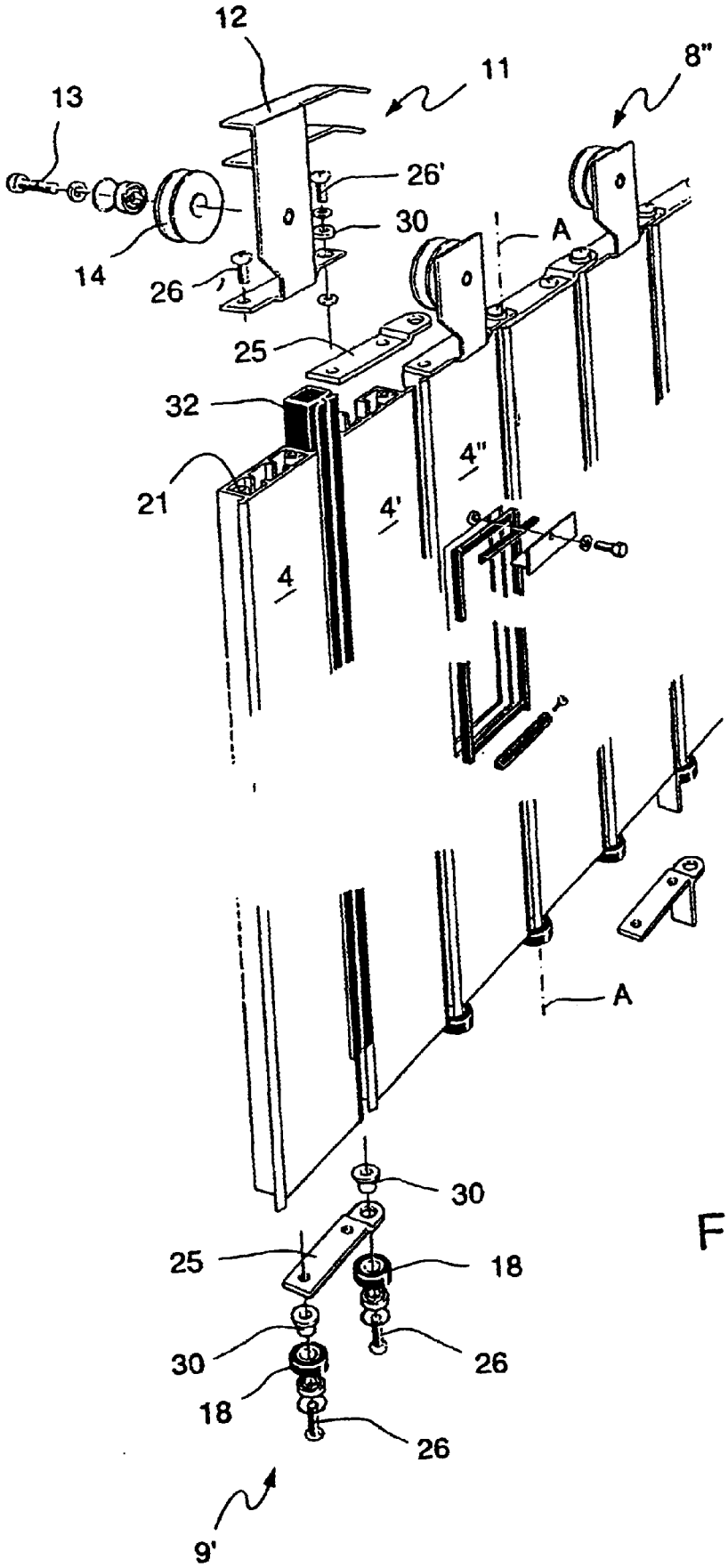
FIG. 3 is a perspective view of the sliding door shown with separated parts.

Referring to FIG. 1, a horizontal opening door fitted on a conventional lift cage 2 is generally designated 1. The door leaf 3 is of louvre type, i.e. comprising several sequentially arranged vertical and interlinked jointed sections 4, in which each section is designed as a principally rigid unit. The flexible joint between the sections is defined on the drawings as a joint axis A, around which adjoining sections 4, 4' (FIG. 3) can rotate in relation to each other between a position in which the sections are aligned with each other and a position where they are at an angle to each other.

When carrying out opening and closing motions, the door leaf 3 is moved horizontally as indicated by the double-headed arrow 5. When the door 1 is open, the door leaf 3, as shown in FIG. 1, is moved to one side so that it principally surrounds one wall of the lift cage 2, whereby the lift cage opening 6 is essentially completely exposed. Given that the sliding door moves outside and around one corner of the lift cage 2, the particular use of this type of door is in areas where the door must not occupy any part of the lift cage load carrying surface 7. Furthermore, conveying e.g. pallets and other bulky objects in and out of the lift cage is facilitated due to the ability to completely expose the door opening 6.

The door leaf 3 slides in the lift cage 2 along upper and lower guide members designated 8 and 9 respectively running between the door leaf 3 and the lift cage 2. Each guide member 8,9 comprises a first and a second interacting guide element 8', 8" and 9', 9" (FIG. 5) respectively, where at least one of the said guide elements comprises an elastic material.

Figure 4:
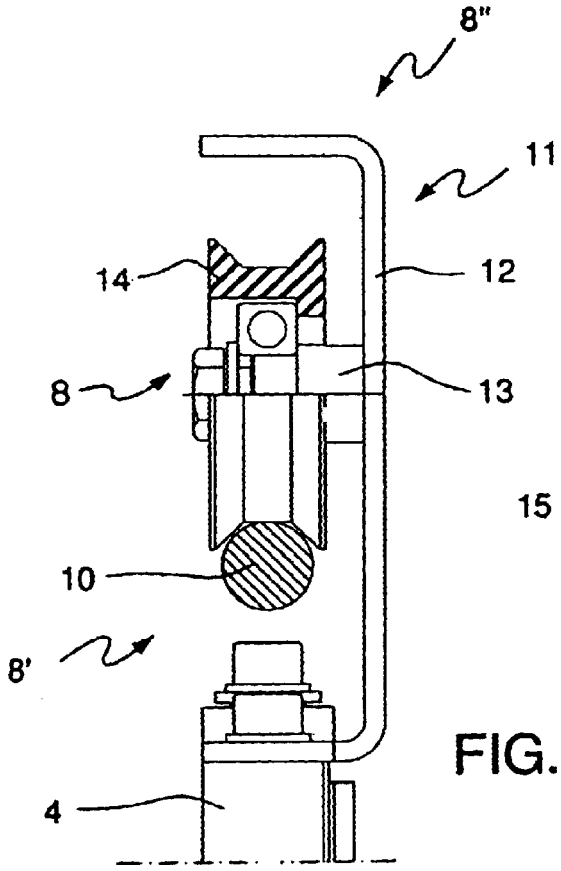
FIG. 4 is an enlargement view of an upper guide in the sliding door in the form of a cross section along the line IV—IV in FIG. 2.
Figure 5:
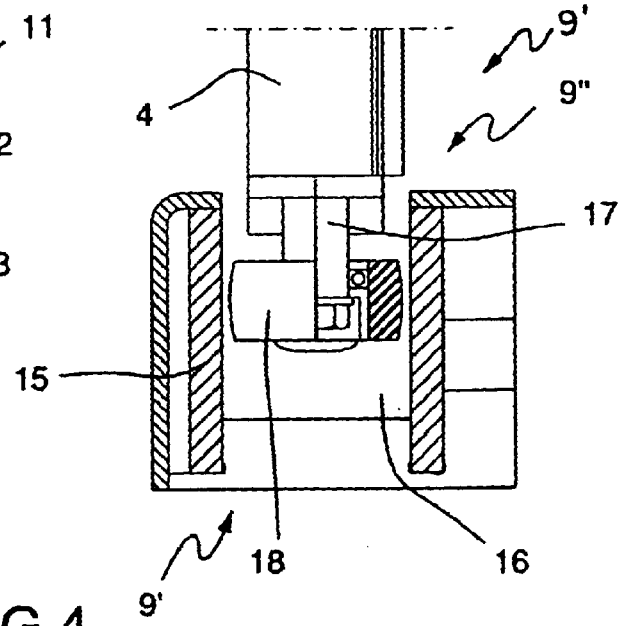
FIG. 5 is an enlargement view in the form of a cross section along the line V—V in FIG. 2.

As illustrated in FIG. 4 and FIG. 5, the first guide element 8' of the upper guide member 8 comprises a guide rail 10 arranged on the lift cage 2 and the second guide element comprises a carriage 11 arranged at the top of the said sections 4. The said carriage 11 comprises a mainly U-shaped supporting arm 12 with a shaft 13 having a journalled roller 14 that runs in a groove in the guide rail 10 and has an external circumference of an elastomeric material, which acts on the said guide rail. The first guide element 9' of the lower guide member 9 comprises a guide rail 15 made of joined sheet with a grooved channel 16 and the second guide element 9" comprises a shaft 17 having a journalled roller 18 running along the said channel 16 with a circumference of elastomeric material that acts on the inside surfaces of the grooved channel 16 in the guide rail 15.

Figure 6:
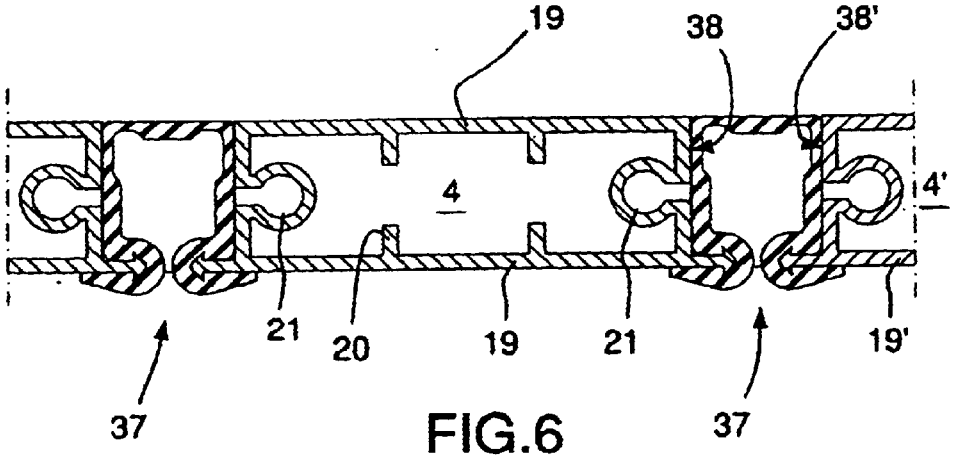
FIG. 6 is an enlargement view of a cross section along the line VI—VI in FIG. 2.

The sections 4 are manufactured of a lightweight material, which in this embodiment comprises extruded aluminum and, as illustrated in FIG. 6, the sections 4 are produced with an outer hollow part 19, from which a number of lateral reinforcements 20 emanate. At the ends of the bottom and top edges of each section 4, generally designated 22 and 23 respectively in FIG. 7 and FIG. 8, there are openings 21 running continuously along the length of the section.

Figure 7:
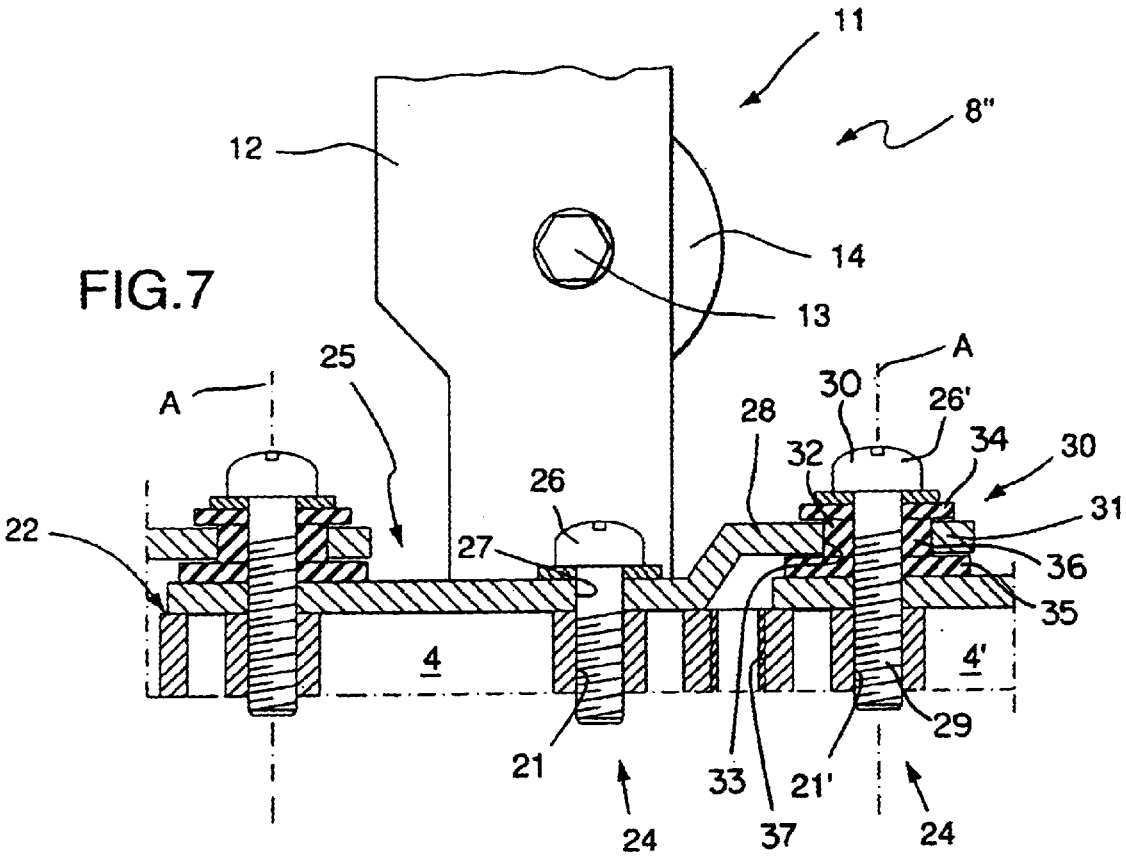
FIG. 7 is a cross sectional view of the upper guide for adjoining sections included in the sliding door.
Figure 8:
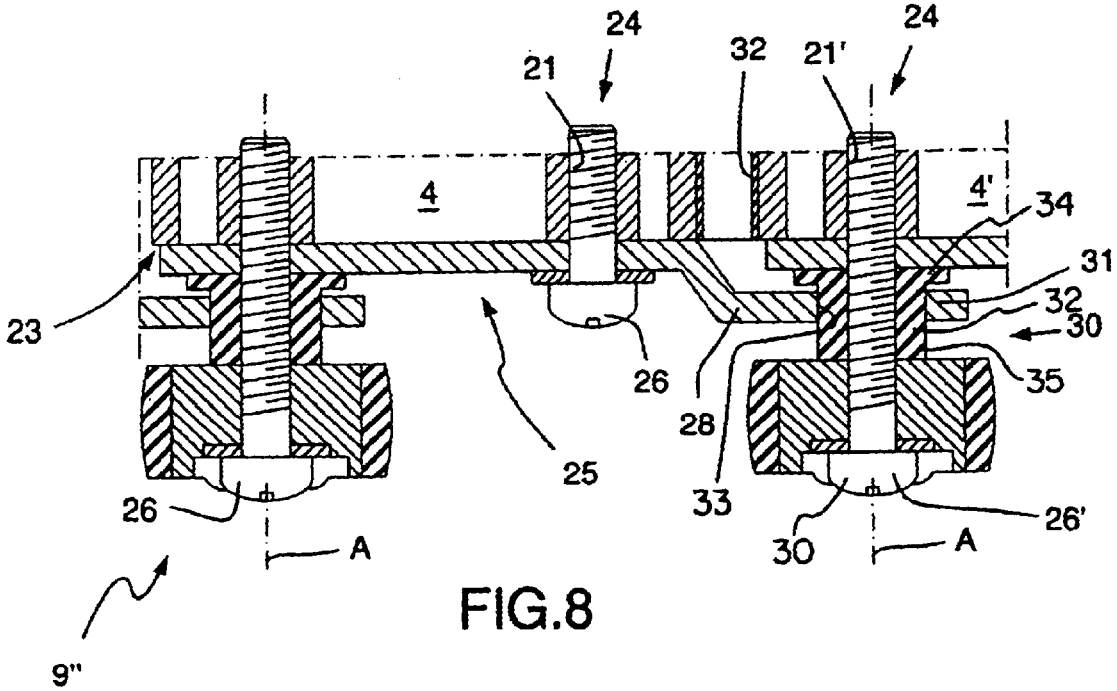
FIG. 8 is a cross sectional view of the lower guide for adjoining sections included in the sliding door.

Referring to FIG. 7 and FIG. 8, each such opening 21 is designed to receive a continuous means of attachment, generally designated 24, running through the length of the section to secure a respective means of connection, generally designated 25, to the ends of the top and bottom edges, 22 and 23 respectively, of each section 4. Each such means of attachment 24 comprises a shaft 26 running through holes 27 arranged in the means of connection 25 and at each end is fitted with a means 28 for fastening the means of connection 25 to the ends of each edge 22, 33 of the section 4. For the described embodiment of this invention, the said means of attachment 24 comprises a thread 29 and associated nut 30 on each end of a shaft 26 but could equally comprise a groove with associated retaining ring on each end of the shaft or any similar arrangement.

Each of the said connecting devices 25 fitted on one section 4 exhibits a cantilever 31 projecting from the section in the same direction, whereby an adjoining section 4' illustrated in the figure on the right is flexibly joined between the said projecting cantilevers 31 with an attaching device 24 similar to the type described above. For the flexible joint between the said two adjoining sections 4 and 4' respectively, running the length of the opening 21' in the section 4', there is a shaft 26' that, via a bearing box 32 at the ends, is flexibly connected to both projecting cantilevers 31 running through holes 33 arranged in each of them. For the flexible joint between the sections 4 and 4', the projecting cantilever 31 on the connecting device 25 has through bending been laterally displaced to a certain degree from the principal plane of the connecting device and thereby also the ends of each edge 22, 23 of the section 4 seen from the inside. In this way, a space is formed so that the following section 4' can be accommodated and flexibly connected to the area between the said projecting cantilever 31, as illustrated in FIG. 7 and FIG. 8. As illustrated in FIG. 7 and FIG. 8, the connecting devices 25 will consequently be arranged in a partly overlapping and linked manner between the consecutively disposed sections 4, 4'. The joint axis A between the adjacent sections 4, 4' is applied to one of the sections 4' and runs through the same so that the second section 4 can pivot at a radial distance from the section 4' around the joint axis A, which is also illustrated in FIG. 8.

The bearing box 32 comprises a somewhat damping elastic material and is arranged in the vicinity of the flexible joint between the said connecting device 25 and attaching device 24 so that structure-borne sound is not conveyed to the flexible joints of adjoining sections 4, 4'.

The bearing box 32 comprises a first and a second part 34 and 35 respectively, where each such part is designed as a sleeve 36 with a support flange 37 made of rubber or equivalent plastic material. The sleeve-shaped part 36 is employed in a ring-shaped area defined between the connecting device 25 hole 33 and the part of the shaft 26' that runs through the said hole. The sleeve-shaped part 36 thereby forms in principle a radial bearing between the connecting device 25 and the shaft 26' running through the section 4' and acts as an elastic damper that separates the said parts from each other in the flexible joint between the sections 4, 4'. The support flanges 36 of the first part 34 and the second part 35 form in a similar way an axial and elastic insulating bearing between the projecting cantilever 31 of the connecting device 25 and the section 4'.

It should be understood that in the same manner as described above, an adjacent third section 4" is flexibly joined to the second section 4' and so on to create a succession of (n) pivoting sections 4:1–4:n forming a continuous door leaf 3.

With reference to FIG. 6, jointing elements of slightly yielding elastic material generally designated 37 are fastened to the area or to the joint between each of the adjoining sections 4, 4' and the remotely located flanking edges 38, 38'. The said jointing elements 37 are intended to achieve a relative butt joint between the sections 4, 4' so that structure-borne sound is not conveyed between them. Jointing element 37 is also intended to act as a crush guard between the sections 4, 4' while the door leaf 3 is in motion and to prevent snow and dust from penetrating into the lift cage 2. The material in the jointing element 37 should be chosen so that the relative flexibility between the sections 4 is not negatively affected. For example, the jointing element 37 can be made of ethylene-propylene rubber or some other suitable thermoplastic or synthetic rubber that is easy to form and can be produced by extrusion.

Figure 10:
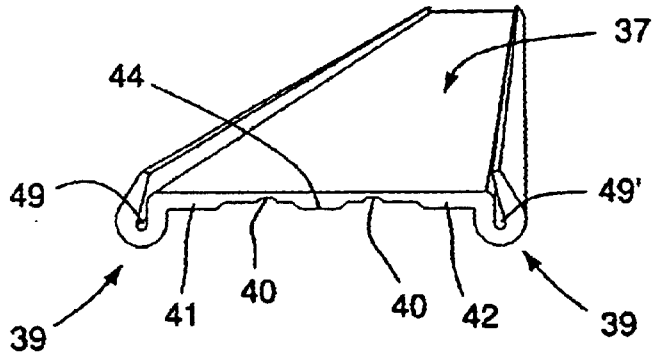
FIG. 10 is a perspective view of a jointing element included in the sliding door and FIG. 11 is an enlarged cross sectional view of two adjoining sections in the circle 11 of FIG. 9.
Figure 11:
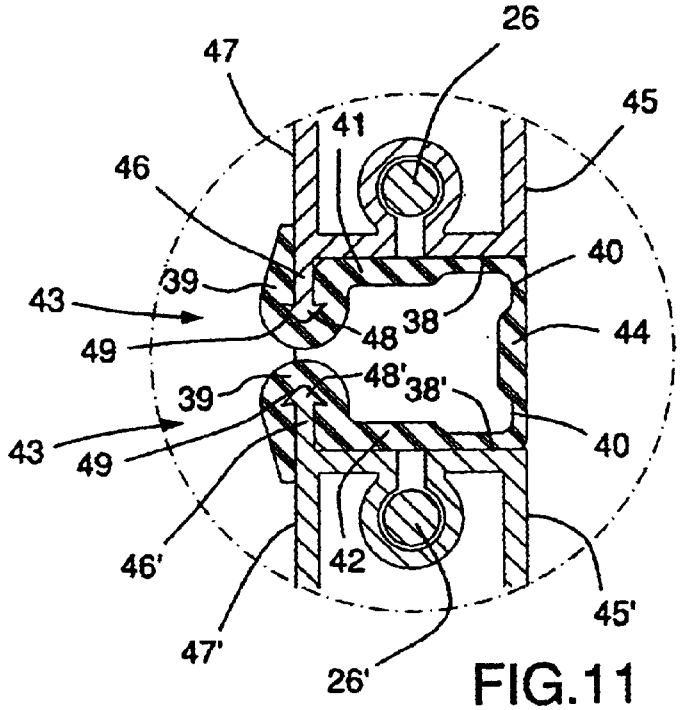

A jointing element 37 is exemplified in FIG. 10, from which it is evident that it mainly comprises of a flat extrusion exhibiting a fluted depression generally designated 39 that is arranged along the side edges of the extrusion and two longitudinal folding notches 40 that are located in the center of the extrusion, along which the extrusion can be folded so that when mounted, it exhibits a mainly groove-shaped appearance illustrated in FIG. 11.

When fitted and in cross-sectional view, the extruded jointing element 37 exhibits a first and a second partition 41 and 42 respectively that via joints generally designated 43 are connected to the side edges 38, 38' of the adjoining sections 4, 4'. The first and second partitions 41, 42 are relatively connecting via a first sidewall 44 forming a transition that is in line with the outer sides 45, 45' of the adjoining sections 4, 4'. The fluted depressions 39 running along the side edges each define a seat or a pick-up area corresponding to a protrusion 46, 46' coming from the butting side edges 38, 38' of the respective adjoining sections 4, 4'. The said protrusions 46, 46' are designed to extend the outsides 47, 47' of the adjoining sections 4, 4' to provide, as should be understood, support and a contact surface for the adjoining sections 4, 4' when they are in alignment. In order to prevent structure-borne sound from being conveyed between the said protrusions 46, 46' and thereby also between adjoining sections 4, 4', the said protrusions are contained within the fluted depressions 39 in a manner in which they are essentially surrounded and embedded.

The joints 43 between the first and second partitions 41, 42 of the jointing elements 37 and the abutting side edges 38, 38' comprise a sharp-edged and almost arrow-like boss 48, 48' arranged on the free end of the protrusion 46, 46', which, in order to attain a locking action between the respective partitions 41, 42 of the jointing element 37 and the abutting edges 38, 38' of the adjoining sections, interact with an undercut groove 49 that is arranged in the bottom of the fluted depression 39. As a result of this design, the jointing element 37 can very easily be anchored to and engage a considerably locking grip in the abutting side edges 38, 38' of the adjoining sections 4, 4' with only hand pressure or with the use of a rubber mallet.

Figure 9:
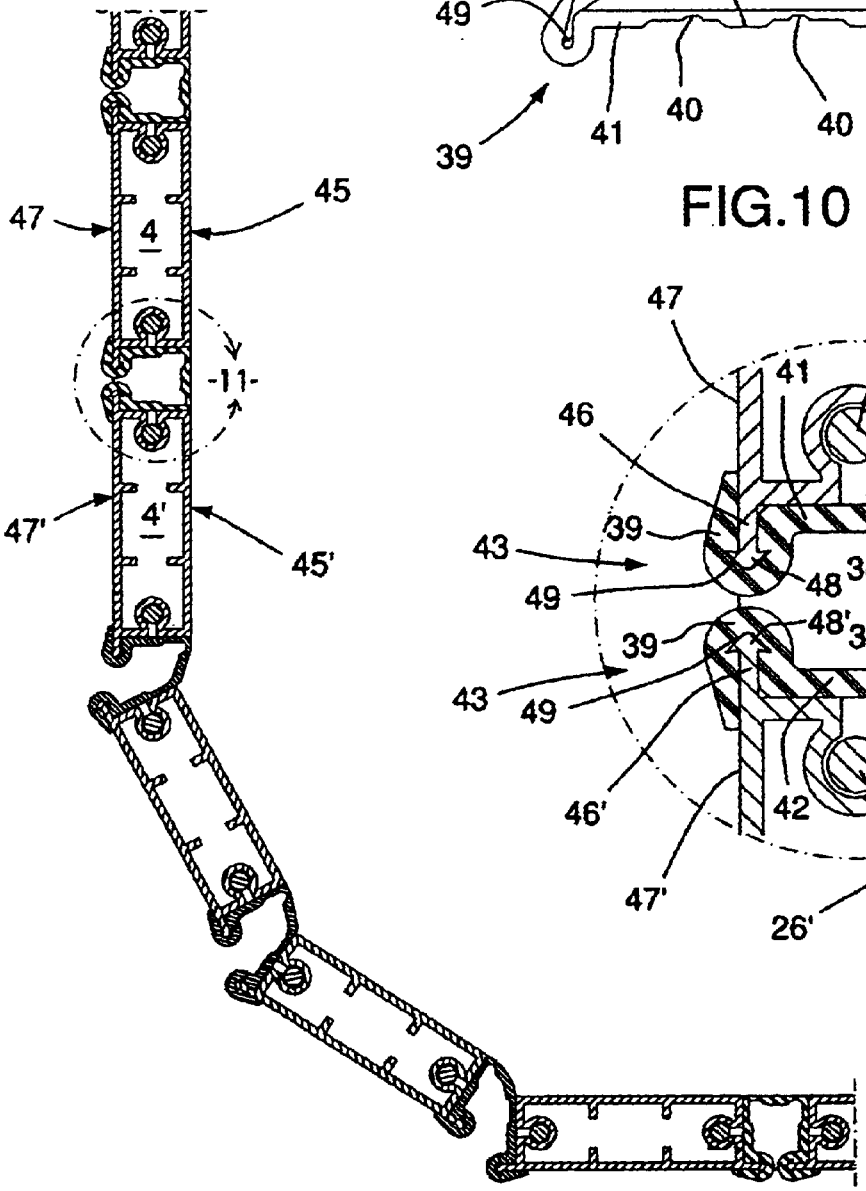
FIG. 9 is a cross sectional view through several adjoining sections included in the sliding door.

As the joint axis A is located in one of the adjoining sections 4, 4' and the jointing element has partly a divisible sidewall formed by both the protrusions 46, 46' and the fluted depressions 39 surrounding the said protrusions and partly a flexible sidewall 44, it has the advantage that the adjoining sections 4 act like a hinge that can be rotated relative to each other without the jointing element 37 offering any appreciable resistance to the rotating motion. In the main, this property is achieved partly because one of the sidewalls of the jointing element 37 is divisible so that rotation is obtained only via the first sidewall 44 and partly because the first sidewall is not compressed during the actual rotating motion but is only folded along the notches 40. This should become clear after a close study of FIG. 9 and FIG. 11. It should also be understood that such detrimental compression of the first sidewall of the jointing element would nevertheless arise if the joint axis A were to be located on the geometrical axis between the sections 4 and 4', i.e. principally half way between the adjoining sections.

The present invention is not limited to the above description or as illustrated in the drawings but can be changed and modified in a number of different ways within the framework of the idea of invention specified in the following claims.

What is claimed is:

1. Arrangement for a sliding door on a mobile unit which defines a door opening and where a door leaf comprises a plurality of interlinked and jointed sections in which adjoining sections are able to rotate around a joint axis from a position in which the sections are in alignment with each other to a relative angled position, whereby the door leaf can slide in the door opening in guides, each of which comprising first and second interacting guide elements, the first interacting guide elements arranged on two opposing end edges of the door leaf and the second interacting guide elements arranged on corresponding sides of the door opening, characterized in that at least one of the first and second interacting guide elements comprises an elastically deformable material separating each of the first interacting guide elements on the door leaf and the second interacting guide elements from each other, a continuous jointing element of elastically deformable material fastened between abutting side edges of the adjoining sections for flexibly joining the abutting side edges of the sections with each other, the jointing element is fluted and exhibits first and second partitions that via a joint are connected to the abutting side edges of the adjoining sections, a first sidewall connecting the first and second partitions forms a transition between first outside surfaces of the adjoining sections, a fluted depression arranged on each longitudinal side edge of the jointing element that surrounds Protrusions emanating from each of the abutting side edges of adjoining sections in a position in which the adjoining sections are aligned with each other to form a transition between the second outside surfaces of the adjoining sections.

2. Arrangement according to claim 1, wherein the second interacting guide elements arranged on the corresponding sides of the door opening comprise guide rails and the first interacting guide elements comprise rollers, whereby the door leaf is guided in the door opening through interaction between the rollers and guide rails.

3. Arrangement according to claim 2, wherein the elastically deformable material separating the first and second interacting guide elements is arranged on at least one of the rollers and guide rails.

4. Arrangement according to claim 3, wherein the elastically deformable material separating the first and second interacting guide elements is arranged as a layer outside the rollers.

5. Arrangement according to claim 1, wherein the sidewall of the jointing element includes folding notches extending along the length of the jointing element.

6. Arrangement according to claim 1, wherein the protrusions are designed as extensions of the respective second outside surfaces of the adjoining sections.

7. Arrangement according to claim 1, wherein each protrusion has a sharp-edged boss on a free end thereof which interacts with an undercut groove arranged in the fluted depression.

8. Arrangement according to claim 1, wherein the joint axis between the adjoining sections is located on one of the adjoining sections and runs therethrough so that the other of the adjoining sections can rotate around the joint axis at a radial distance from the one of the adjoining sections.

9. Arrangement according to claim 1, further including a connecting device connecting opposite end edges of the adjoining sections and exhibiting cantilevered ends that project in a direction from one adjoining section and therebetween accommodate the other adjoining section in rotating bearing joints.

10. Arrangement according to claim 9, wherein the first and second interacting guide elements are interconnected with the connecting devices of the adjoining sections.

11. Arrangement according to claim 10, wherein each rotating bearing joint between adjoining sections comprises a shaft attached to the other adjoining section and which via a bearing box of elastic material is flexibly connected to the projecting cantilevered end running through a hole arranged therein.

12. Arrangement for a sliding door on a mobile unit which defines a door opening and where a door leaf comprises a plurality of interlinked and jointed sections in which adjoining sections are able to rotate around a joint axis from a position in which the sections are in alignment with each other to a relative angled position, whereby the door leaf can slide in the door opening in guides, each of which comprising first and second interacting guide elements, the first interacting guide elements arranged on two opposing end edges of the door leaf and the second interacting guide elements arranged on corresponding sides of the door opening, characterized in that between the adjoining sections of the plurality of interlinked and jointed sections is an elastically deformable material separating the adjoining sections from each other and that at least one of the first and second interacting guide elements comprises an elastically deformable material separating the first interacting guide elements on the door leaf and the second interacting guide elements arranged on the corresponding sides of the door opening and that the jointing element is fluted and exhibits first and second partitions that via a joint are connected to the abutting side edges of the adjoining sections, a first sidewall connecting the first and second partitions forms a transition between first outside surfaces of the adjoining sections, a fluted depression arranged on each longitudinal side edge of the jointing element that surrounds protrusions emanating from each of the abutting side edges of the adjoining sections in a position in which the adjoining sections are aligned with each other to form a transition between second outside surfaces of the adjoining sections.

13. Arrangement according to claim 12, wherein the sidewall of each jointing element includes folding notches.

14. Arrangement according to claim 12, wherein the protrusions are designed as extensions of the respective second outside surfaces of the adjoining sections.

15. Arrangement according to claim 12, wherein each protrusion has a sharp-edged boss on a free end thereof which interacts with an undercut groove arranged in the fluted depression.

16. Arrangement for a sliding door on a mobile unit which defines a door opening and where a door leaf comprises a plurality of interlinked and Jointed sections in which adjoining sections are able to rotate around a joint axis from a position in which the sections are in alignment with each other to a relative angled position, whereby the door leaf can slide in the door opening in guides, each of which comprising first and second interacting guide elements, the first interacting guide elements arranged on two opposing end edges of the door leaf and the second interacting guide elements arranged on corresponding sides of the door opening, characterized in that between the adjoining sections of the plurality of interlinked and jointed sections is an elastically deformable material separating the adjoining sections from each other and that at least one of the first and second interacting guide elements comprises an elastically deformable material separating the first interacting guide elements on the door leaf and the second interacting guide elements arranged on the corresponding sides of the door opening and that the joint axis between the adjoining sections is located on one of the adjoining sections and runs therethrough so that the other of the adjoining sections can rotate around the joint axis at a radial distance from the one of the adjoining sections.

17. Arrangement for a sliding door on a mobile unit which defines a door opening and where a door leaf comprises a plurality of interlinked and jointed sections in which adjoining sections are able to rotate around a joint axis from a position in which the sections are in alignment with each other to a relative angled position, whereby the door leaf can slide in the door opening in guides, each of which comprising first and second interacting guide elements, the first interacting guide elements arranged on two opposing end edges of the door leaf and the second interacting guide elements arranged on corresponding sides of the door opening, characterized in that between the adjoining sections of the plurality of interlinked and jointed sections is an elastically deformable material separating the adjoining sections from each other and that at least one of the first and second interacting guide elements comprises an elastically deformable material separating the first interacting guide elements on the door leaf and the second interacting guide elements arranged on the corresponding sides of the door opening and further including a connecting device for the adjoining sections on each of the opposing end edges, the connecting devices having portions cantilevered from the one of the adjoining sections and accommodating the other of the adjoining sections by creating a rotating bearing joint.

18. Arrangement according to claim 17, wherein the first interacting guide elements are interconnected with the connecting devices of the adjoining sections.

19. Arrangement according to claim 18, wherein the rotating bearing joint between adjoining sections further comprises a shaft running through the other of the adjoining sections and is flexibly joined to the cantilevered portions of the connecting devices of the one of the adjoining sections of the adjoining sections via holes arranged therein and an elastic material ring-shaped bearing box located in the other of the adjoining sections between the hole and the one of the adjoining sections.

20. Arrangement according to claim 17, wherein the rotating bearing joint between adjoining sections further comprises a shaft running through the other of the adjoining sections and is flexibly joined to the cantilevered portions of the connecting devices of the one of the adjoining sections of the adjoining sections via holes arranged therein and an elastic material ring-shaped bearing box located in the other of the adjoining sections between the hole and the one of the adjoining sections.

* * * * *